US005819953A

United States Patent [19]

Julius et al.

[11] Patent Number: 5,819,953

[45] Date of Patent: Oct. 13, 1998

[54] METHOD AND APPARATUS FOR SORTING CAPSULES

[75] Inventors: Klaus Julius, Marienheide; Christoph Bagusche, Hirschhorn, both of Germany

[73] Assignee: R. P. Scherer GmbH, Germany

[21] Appl. No.: 362,588

[22] PCT Filed: Jun. 16, 1993

[86] PCT No.: PCT/EP93/01534

§ 371 Date: Jun. 12, 1995

§ 102(e) Date: Jun. 12, 1995

[87] PCT Pub. No.: WO94/00249

PCT Pub. Date: Jan. 6, 1994

[30] Foreign Application Priority Data

Jun. 26, 1992 [DE] Germany ..... 42 21 107.7

[51] Int. Cl.[6] ..... B07C 5/00

[52] U.S. Cl. ..... 209/561; 209/563; 209/919; 198/518

[58] Field of Search ..... 209/552, 559, 209/576, 580, 581, 587, 588, 914, 919, 938, 939, 561, 562, 563, 621; 198/397, 443, 518

[56] References Cited

U.S. PATENT DOCUMENTS

| | | | |
|---|---|---|---|
| 2,617,527 | 11/1952 | Smith | 209/919 X |
| 4,144,970 | 3/1979 | McKnight et al. | 209/914 X |
| 4,300,689 | 11/1981 | Franklin et al. | 209/588 X |

FOREIGN PATENT DOCUMENTS

| | | | |
|---|---|---|---|
| 1388112 | 4/1988 | U.S.S.R. | 209/919 |

*Primary Examiner*—Tuan Nguyen
*Attorney, Agent, or Firm*—McDonnell Boehnen Hulbert & Berghoff

[57] ABSTRACT

Disclosed is an apparatus for sorting capsules of hard or soft gelatin, starch or another material, for faultless and faulty capsules. In the apparatus, capsules are first fed from a supply container holders in a control station, then conveyed in the capsule holders through individual control positions in the control station where they are observed using cameras. The images acquired by the cameras are evaluated to determine production faults in the capsules. The faulty capsules are finally ejected from the control station separately from faultless capsules.

14 Claims, 5 Drawing Sheets

METHOD AND APPARATUS FOR SORTING CAPSULES

The invention relates to a method and an apparatus for sorting capsules for faultless and faulty capsules, for example capsules for drugs to be administered orally.

Such capsules are used mainly as enclosure or container for a pulverulent or granulated medicament and are taken together with the latter. These capsules consist of a physiologically compatible material, for example hard or soft gelatins, starch or another material which does not contain the active substances of the medicament. Hereinafter, usually only gelatin capsules are mentioned as example. Gelatin capsules are produced as mass product in high-performance production processes from gelatin or gelatin solution. A distinction is made between hard gelatin capsules and soft gelatin capsules.

Hard gelatin capsules consist of a hollow cap and a hollow body which are produced simultaneously on one machine. The capsule parts are provisionally joined together to a finished capsule without filling, resulting in a small empty container in oblong form. To ensure the quality of the end product, in the manufacture of the hard gelatin capsules very high demands are made on the dimensional accuracy and cleanness of the corresponding machine components and the capsule parts made therewith.

Hard gelatin capsules are produced in various colours and colour combinations, transparent and opaque. Depending on the size, the empty hard capsule has a weight of about 30 to 130 mg.

With regard to the further processing, the dimensional accuracy and stability of the hard gelatin capsules is of particular significance. They are passed onto the pharmaceutical industry as empty capsules and filled there with the drug. To do this the empty capsules are separated into the caps and bodies, the body receiving the filling and the empty cap then being placed on again. By pressure the two capsule halves are firmly and permanently joined so that the content cannot escape.

The hard gelatin capsules made on conventional production machines may have faults, for example holes, deformations or bubbles which can present considerable problems during filling. Stoppages of the filling machines possibly resulting therefrom are to be avoided. Consequently, faulty capsules must be sorted out at the manufacturers themselves.

At present this sorting operation is carried out by manual sorting. The capsules to be sorted drop from a container mounted on a vibrator onto a transparent conveyor belt. The capsules on said conveyor or sorting belt are illuminated from below or above. One or more persons conduct a visual inspection of the capsules and remove the defective capsules by hand from the conveying belt passing by. Each control person sees on a sorting belt only about 30 to 40% of the surface of a capsule. A complete control of the quality of the capsule is thus not possible. Moreover, the result of such a quality control is influenced substantially by the attentiveness of the particular control person and by their subjective assessment.

The problem underlying the invention is therefore to provide a method and an associated apparatus for sorting capsules for faultless and faulty capsules in which the problems involved with manual sorting of the capsules are eliminated. In particular, the sorting of the capsules is to be carried out without control persons and therefore automated.

The invention describes a method and an apparatus for sorting out faulty capsules; the capsules can be observed all round in a control station in individual control positions by means of cameras. The images picked up by the cameras are evaluated by means of computer programs to determine production faults. Finally, the faulty capsules are sorted out in accordance with the result of the evaluation.

A method according to the invention for sorting capsules is described in claim 1. Claims 2 to 8 characterize further inspection of the capsules due to the all round observation. Since human inadequacies are eliminated, the result of the sorting operation is considerably improved. The producers of capsules can thus meet the quality demands of the pharmaceutical industry as customers for the capsules.

The sorting method and the sorting apparatus according to the invention may for example be used for sorting out faulty, empty previously sealed or filled sealed hard gelatin capsules. In addition, the invention can also be employed for sorting soft gelatin capsules, capsules of starch or other materials and tablets, coated tablets and lozenges.

An example of the invention serving to sort transparent or opaque empty, presealed hard gelatin capsules will be described in detail hereinafter with the aid of the drawings.

Figure 1:
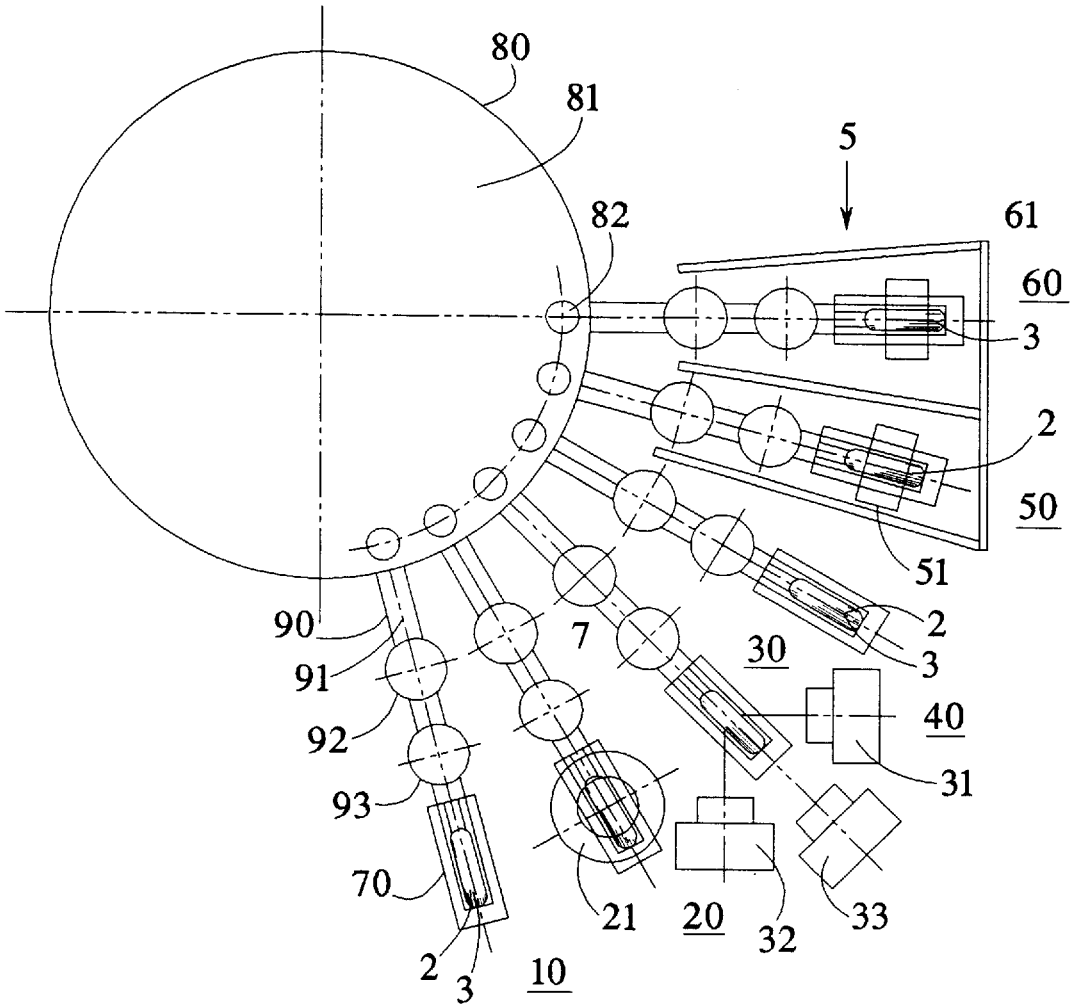
FIG. 1 shows a schematic view of a sorting apparatus with a control station from above.

The apparatus for sorting gelatin capsules for faultless capsules 2 and faulty capsules 3 consists of at least one control station 5 having various control positions 10, 20, 30, 40, 50, 60 for receiving the capsules 2, 3 and assessing the properties thereof. In the control positions the capsules 2, 3 are held by capsule holding means 70. Furthermore, the sorting apparatus comprises feed means 90 by which the capsules 2, 3 pass from a supply container 80 to the capsule holding means 70, and ejection means 51, 61 by which the faultless capsules 2 are ejected separately from the faulty capsules 3 from the control station 5.

In each capsule holder 70 a capsule 2, 3 is held and is conveyed in said holder through six control positions 10, 20, 30, 40, 50, 60 in the control station 5. At the first control position 10 in the control station 5 the capsules 2, 3 are held ready in the capsule holders 70. For this purpose the capsules are removed from the supply container 80 and arranged in the feed means 90 on a guide path 7 in rows of capsules lying bunched one behind the other. The feed means 90 consists of a downwardly directed tube 91 which is secured with its upper end to a bottom plate 81 of the supply container 80. Driven by a stepping motor the bottom plate 81 rotates relatively to the stationary housing 83 of the supply container 80, the capsules 2, 3 thereby passing from the supply container via holes 82 in the bottom plate 81 into the tube 91.

The feed means 90 comprises two blocking bolts 92, 93 which are arranged one behind the other and are controlled mechanically via guides so that they are consecutively raised. The first blocking bolt 92 serves to pile up the capsules 2, 3 in the tube 91 whilst the second blocking bolt 93 separates the capsules 2, 3 individually from the pile-up into the capsule holder 70. The blocking bolts thus make it possible for only one capsule to be present in the capsule holder at any time. If several capsules were to lie simultaneously in a capsule holder problems would be encountered in the further course of the control process. In particular, the capsules could jam on ejection at the end of the control station 5.

The control holder 70 is secured to the outer lower end of the feed means 90. It consists of a U-shaped trapezoidal upwardly open rail 71 which comprises at its lower side a slot 72 extending in the conveying direction of the capsules 2, 3 and having pointed edges on which the capsules bear. At its outer end the capsule holder 70 comprises a tip, for example in the form of a grub screw, for supporting the capsules.

After being made ready in the capsule holder 70 at the first control position 10 in the control station 5 the capsules 2, 3 are conveyed through the following control positions 20, 30, 40, 50, 60. To inspect the capsules for production faults, at the second and third control position 20, 30 in the control station 5 cameras 21, 31, 32, 33 and light sources 22, 34 are arranged for complete all round observation of the capsules. For each camera 21, 31, 32, 33 a separate image-processing computer program is provided which electronically evaluates the image picked up and determines therefrom the quality of the capsules. Since capsules of different colours are to be controlled, a colour identification is contained in the computer program.

The light sources 22, 34 in the control positions 20, 30 consist of light-emitting diodes which emit a light in a range visible to the cameras and suitable for illuminating the capsules 2, 3. The cameras in the control stations are arranged essentially on the other side of the capsules opposite the light source. If a transparent or opaque capsule is inspected, the light from the light source passes through said capsule substantially in the direction towards the cameras.

Thus, by the specific arrangement of the light sources and the cameras in the second and third control stations 20, 30 a complete all round observation of the capsules is possible and any fault which can possibly occur in capsules can be detected. It may for example be determined whether the capsules have holes, bubbles, deformations or contaminations at any point whatever. In addition, the dome on the cap and body of the capsule is checked for damage. Furthermore, the position of the capsule (for example cap at the top or bottom), the length and the diameter of the cap and body of the capsule are determined and the sharp edge of the cap examined for irregularities.

The points at which the capsule is supported in the capsule holder 70, i.e. the edges at the slot 72 of the rail 71 and the screw tip at the end of the capsule holder 70 are dimensioned and arranged in such a manner that all the areas of the capsule can be transilluminated or illuminated and detected by the cameras 21, 31, 32, 33.

Figure 2:
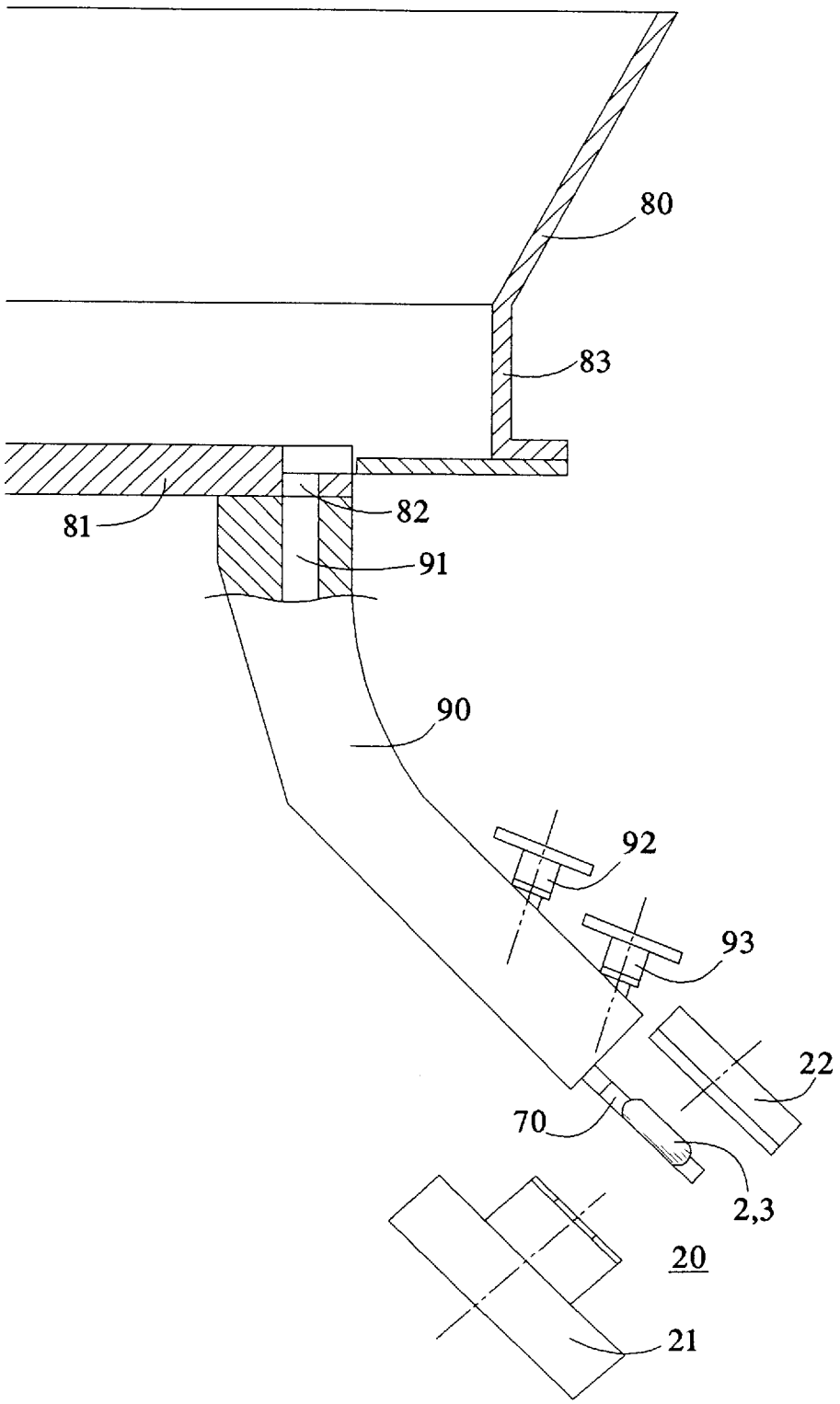
FIG. 2 is a side view, partially in section, of a control position of the sorting apparatus.
Figure 3:
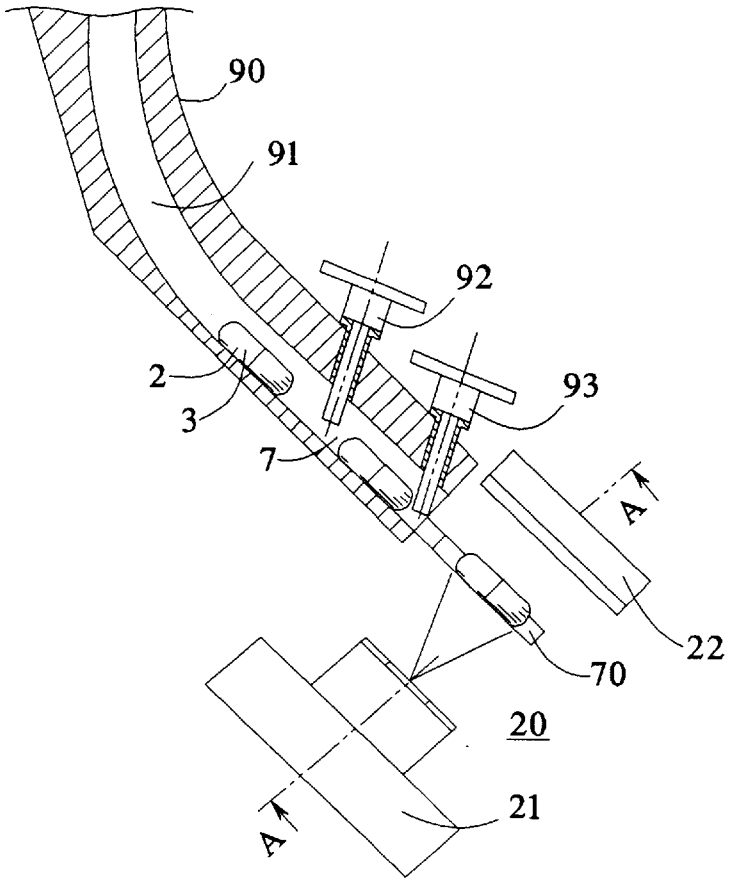
FIG. 3 is a side view of the control position of FIG. 2 in section.
Figure 4:
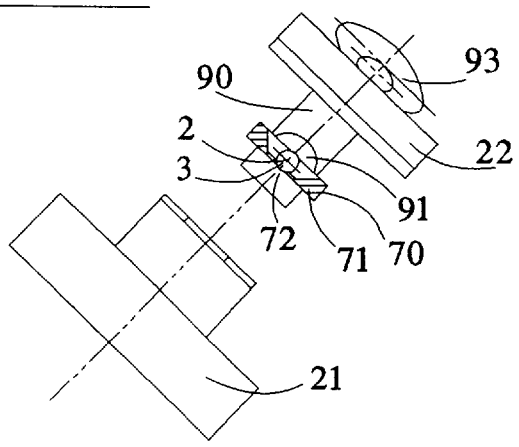
FIG. 4 is a view in section along the line A—A of FIG. 3.

In the second control position 20 in the control station 5 (FIGS. 2 to 4) the capsules 2, 3 are observed by a first camera 21. The camera 21 is arranged below the capsule holder 70, i.e. beneath the feed path 7 of the capsules, so that it sees the capsules from below/behind. Above the capsule holder 70, i.e. above the feed path 7 and thus opposite the camera 21, a light source 22 is arranged which illuminates the capsules 2, 3 from above/the front.

Figure 5:
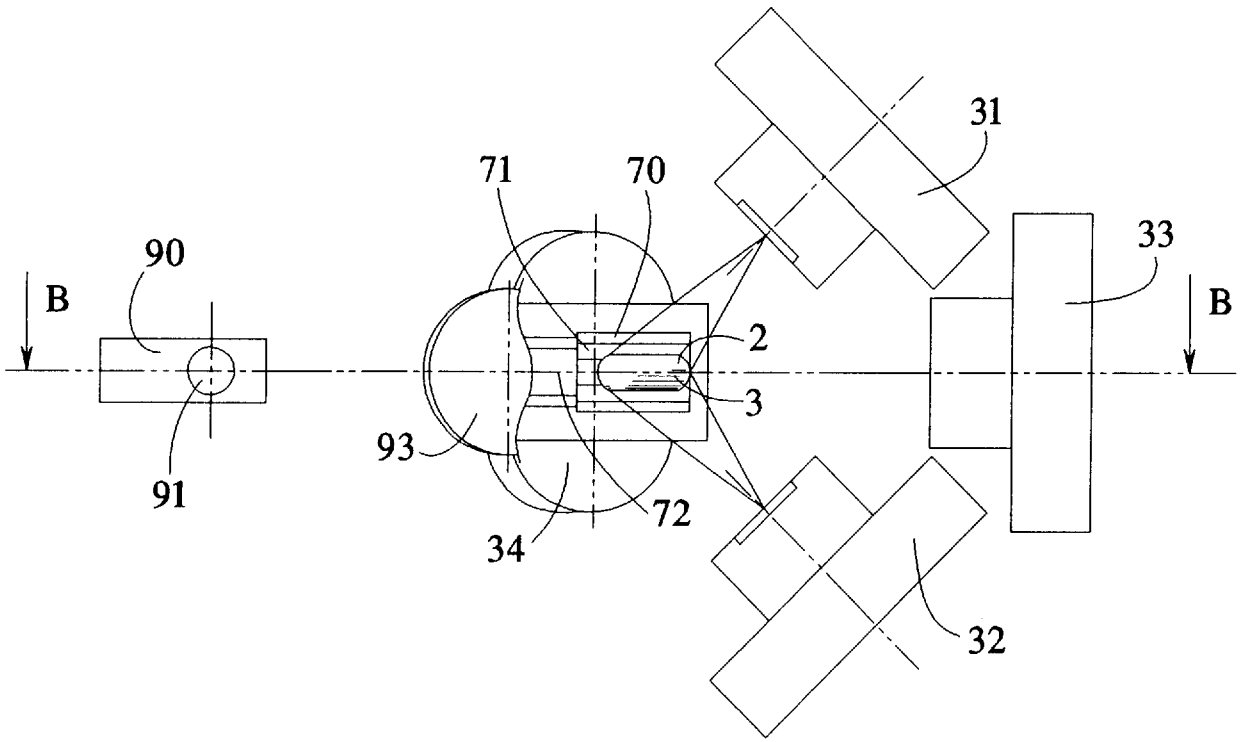
FIG. 5 is a view of another control position of the sorting apparatus, from above.
Figure 6:
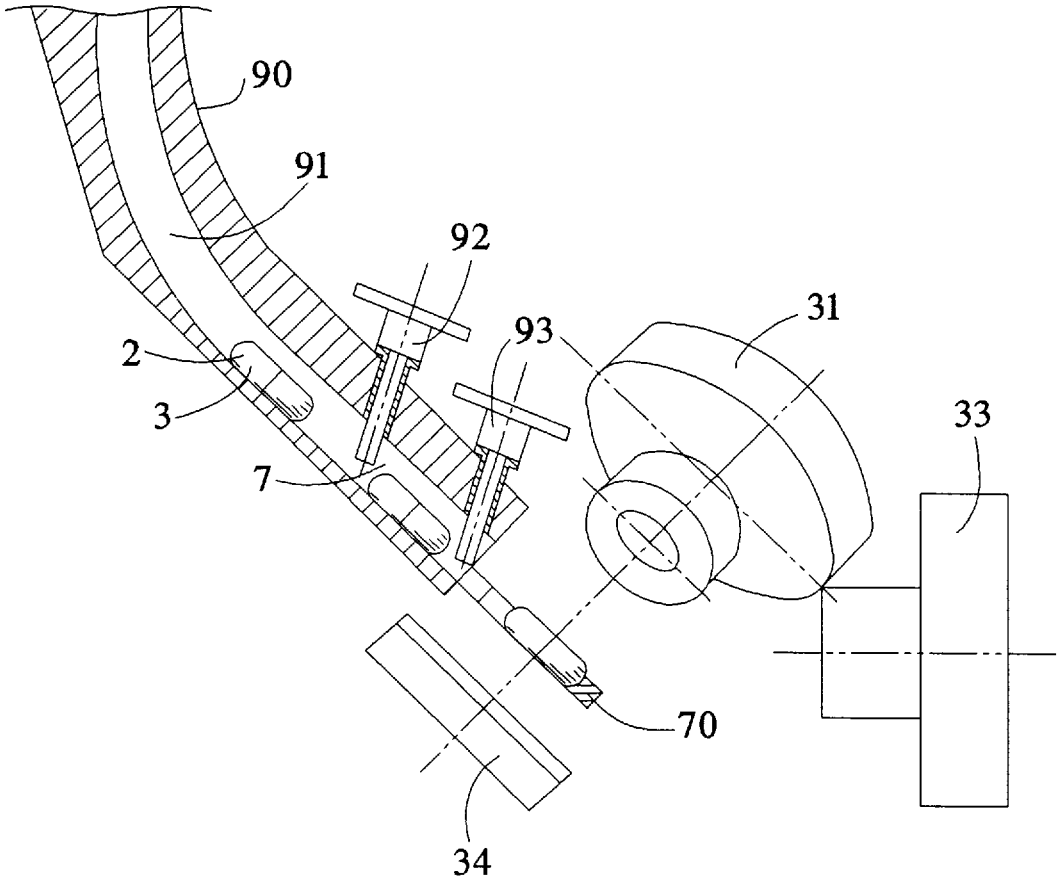
FIG. 6 is a side view in section along the line B—B of FIG. 5.

Since it is not possible to completely inspect the capsules 2, 3 by the camera 21 in the second control position 20, they are again observed in the third control position 30 by means of two cameras 31, 32 from different directions (FIGS. 5 and 6). To illuminate the capsules a further light source 34 is provided. The cameras 31, 32 are arranged obliquely above, at the side of the capsule holder 7, i.e. above and laterally of the feed path 7 of the capsules 2, 3, the one camera 31 observing the capsules from the front right and the other camera 32 observing the capsules from the front left. In addition, a third camera 33 can also be provided if necessary directly above the capsule holder, i.e. above the feed path 7 of the capsules, said camera being inclined to the other two cameras 31, 32 and observing the capsules directly from above/the front. The light source 34 is arranged beneath the capsule holder, i.e. beneath the feed path 7, and illuminates the capsules from below/behind.

The capsules 2, 3 are conveyed in the capsule holders 70 through the control positions 10, 20, 30, 40, 50, 60 but do not themselves move with respect to the capsule holders 70. In the control positions 20 and 30 they are observed by the stationary cameras 21, 31, 32, 33. Thus, as this is done the capsules 2, 3 do not turn with respect to the cameras and nor do the cameras move round the capsules.

The fourth control position 40 is a waiting position during which the computer program evaluates the images taken to determine production faults in the capsules.

The result of the evaluation is converted in the fifth or sixth control position to a separation of the faultless capsules 2 from the faulty capsules 3. For this purpose, in the fifth control position a compressed air valve 51 is provided which is driven by the computer program and activated when the corresponding capsule has no faults. The faultless capsule 2 is thus ejected from the capsule holder 70 by the compressed air valve 51 and received by a collecting container. If the computer program has detected a fault in the capsule the compressed air valve is not activated in the fifth control position 50. On the contrary, the capsule passes through this control position and finally reaches the sixth control position 60. Here, a further compressed air valve 61 is provided which is driven by the computer program and activated when the capsule has a fault. Faulty capsules 3 are therefore ejected from the capsule holder 70 by the compressed air valve 61 at the sixth control position 60 and received by a collecting container.

To ensure a correct function of the sorting apparatus the stepping motor turning the bottom plate 81 of the supply container 80 relatively to the housing 83 thereof, the feed means 90 with the capsule holders 70 thereon, thereby being moved through the six control positions, runs synchronously with the cameras at the control positions 20 and 30. Thus, each camera must take a shot of a capsule exactly when the latter is in the corresponding control position. Whilst the capsule holder moves with the capsule into the next control position the camera should not pick up any image.

Whilst a capsule is being observed in the second control position 20 by the camera 21, the next capsule is already held in readiness in the first control position 10. By further rotating of the capsule holders 70 (in the direction of the arrow in FIG. 1) the first capsule moves to the third control position 30 where it is observed by the cameras 31, 32, 33 whilst the second capsule moves to the second control position 20 and is observed there by the camera 21. Meanwhile, in the first control position 10 a third capsule is already being made available. By again further rotating the capsule holders 70 the first capsule moves to the control position 40, the second capsule to the control position 30, and the third capsule to the control position 20, whilst in the first control position 10 a further capsule is made ready. Whilst the first capsule is disposed in the control position 40 in the waiting position the computer program evaluates the images of the first capsule taken by the cameras in the preceding steps although the following capsules are already being observed by the cameras in the corresponding control positions 20 and 30. The computer program therefore permits a parallel observation and evaluation of consecutive capsules.

In FIG. 1, six feed means 90 with the associated control positions 10, 20, 30, 40, 50, 60 are illustrated schematically only in one quadrant of the circular bottom plate 81 of the supply container 80. This arrangement may be repeated analogously in the other three quadrants of the circular bottom plate so that a total of four control stations 5 each having six control positions are arranged around a supply container 80. With different dimensioning of the bottom plate it is also possible to arrange a greater or lesser number of control stations 5 with the respective associated control positions around the supply container 80.

In the arrangement illustrated in this example of embodiment of four control stations, about 70,000 capsules can be controlled per hour, corresponding to a typical output of a gelatin capsule production machine. Accordingly, about 17,000 to 18,000 control steps are carried out in each of the four control stations per hour. By multiplying the number of the control stations the number of controlled capsules may be accordingly increased.

The described method and the apparatus for sorting empty presealed hard gelatin capsules may for example be connected directly to the production machine of the capsules. However, an arrangement in other production steps is also conceivable, for example in cases where highly opaque or filled hard gelatin capsules or soft gelatin capsules which are filled and sealed directly on production are to be controlled and sorted. In these latter cases the capsule is no longer transparent and consequently cannot be transilluminated by the light sources and the cameras. The cameras and the light sources are then arranged in control positions such that the capsule bodies can be illuminated and observed from the outside only, a complete all round observation of the capsule nevertheless being possible. The same applies to the control of tablets, coated tablets, etc.

We claim:

1. An apparatus for sorting capsules into groups of sound and defective capsules comprising:

(a) a control station comprising a feed path and control positions for receiving the capsules and evaluating the properties of the capsules;

(b) a feed means for feeding the capsules from a supply container to the control station;

(c) a means for producing images of the capsules arranged at control positions in the control station;

(d) a means for endedly ejecting sound capsules and defective capsules;

(e) a plurality of capsule holders for holding the capsules in the control positions;

(f) a means provided in the first control position for feeding the capsules into the capsule holders;

(g) a means for independently ejecting sound capsules and defective capsules from the capsule holders;

wherein the feed means comprises a downwardly directed tube having blocking means for piling up and separating the capsules; and wherein the capsule holders comprise a U-shaped upwardly open rail having at its lower side a slot extending in the conveying direction of the capsules, the rail having pointed edges on which the capsules bear and the rail having at its outer end a tip for supporting the capsules.

2. A sorting apparatus according to claim 1, wherein the means for producing images of the capsules comprises a plurality of light sources and a plurality of cameras, and an image-processing computer program for electronically evaluating the images and for determining the properties of the capsules.

3. A sorting apparatus according to claim 2, wherein the computer program includes color identification means.

4. A sorting apparatus according to claim 2, wherein the light sources comprise light emitting diodes for emitting light in the visible region suitable for transillumination of the capsules.

5. A sorting apparatus according to claim 1, wherein the control station comprises six control positions, wherein (a) the second control position comprises at least one camera arranges to produce images of the capsules from one side;

(b) the third control position comprises at least one camera arranged to produce images of the capsules from a second side; and (c) the fourth control position being a waiting position for holding the capsules while the computer program evaluates at least one image.

6. A sorting apparatus according to claim 5, wherein (a) a camera is provided in the second control position and beneath the feed path which camera produces images of the capsules from below and a light source arranged from above the feed path opposite the camera, which light source illuminates the capsules from above;

(b) the third control position comprising at least two cameras and a light source, the cameras being arranged above the feed path of the capsules such that the first camera in the third control position produces images of the capsules from the front right and the second camera in the third position produces images of capsules from the front left, the light source being arranged beneath the feed path, which light source illuminates the capsules from below;

(c) a first pressurized air valve arranged in the fifth control position and adapted to blast the sound capsules out of the capsule holder;

(d) a second pressurized air valve arranged in the sixth control position and adapted to blast the defective capsules out of the capsule holder.

7. A sorting apparatus according to claim 6, wherein a third camera is provided above the feed path of the capsules and inclined to the two cameras in the third control position, producing images of the capsules directly from above.

8. A sorting apparatus according to claim 6, wherein the apparatus comprises two to four control stations.

9. A sorting apparatus according to claim 1, wherein one capsule at a time is disposed in each capsule holder and passes through the control positions in the control station.

10. A sorting apparatus according to claim 1, wherein the capsule holder is secured to the outer end of the feed means.

11. A sorting apparatus according to claim 1, wherein the feed means is secured by its upper end to a bottom plate of the supply container, the bottom plate defining apertures through which the capsules pass from the supply container into the feed means.

12. A sorting apparatus according to claim 11, wherein the supply container comprises a stepping motor for turning the bottom plate relative to the housing of the supply container.

13. A sorting apparatus according to claim 12, wherein the stepping motor runs synchronously with the means for producing images of the capsules.

14. A sorting apparatus according to claim 11, wherein six (6) feed means are attached to the bottom plate.

* * * * *